United States Patent [19]

Chiu

[11] Patent Number: 4,732,644

[45] Date of Patent: Mar. 22, 1988

[54] AUTOMATIC TAPE-FIXING DEVICE FOR CARTON-SEALING MACHINE

[75] Inventor: Tuan-Mei C. Chiu, Chiayi Hsien, Taiwan

[73] Assignee: Tien Heng Machinery Co., Ltd., Chiayi Hsien, Taiwan

[21] Appl. No.: 744

[22] Filed: Jan. 6, 1987

[51] Int. Cl.[4] ..... B65B 61/00

[52] U.S. Cl. ..... 156/468; 156/477.1; 156/478; 156/480; 156/485; 156/487; 53/137

[58] Field of Search ..... 156/475, 478, 479, 480, 156/487, 491, 486, 485, 522, 521, 468, 477.1; 53/137

[56] References Cited

U.S. PATENT DOCUMENTS

| | | | |
|---|---|---|---|
| 1,843,802 | 2/1932 | Chalmers | 156/477.1 |
| 1,861,144 | 5/1932 | Schmiedel | 156/487 |
| 1,938,654 | 12/1933 | Braren | 156/477.1 |
| 2,087,472 | 7/1937 | Dyment | 156/468 |
| 3,229,594 | 1/1966 | De La Coussaye | 156/468 |
| 4,386,997 | 6/1983 | Molitor | 156/468 |
| 4,572,760 | 2/1986 | Marchetti | 156/468 |

*Primary Examiner*—Donald E. Czaja
*Assistant Examiner*—J. Davis
*Attorney, Agent, or Firm*—Browdy and Neimark

[57] ABSTRACT

The present disclosure is related to an automatic device for applying tapes along the edges of a carton for sealing purpose in general, and more particularly to an automatic tape-applying device which can effect the operation of adhering a partially placed tapes, along the edges of a carton, smoothly to the surface thereof, the carton having been transmitted by conveyor belts via a tape-applying means. The final adherence of the tape to the surface of a carton to be sealed is carried out by two brush members, one short and one elongate; the short brush is actuated to repeatedly move horizontally in a pre-set distance by an air-actuated cylinder so to adhere the tape placed at the corners of the carton to the surface thereof, and the elongated brush is actuated to repeatedly move up and down so to complete the process of the final adherance of the tape fully to the surface thereof automatically.

1 Claim, 9 Drawing Figures

FIG.5-A

AUTOMATIC TAPE-FIXING DEVICE FOR CARTON-SEALING MACHINE

SUMMARY OF THE INVENTION

The present invention relates to an automatic tapeapplying device which is employed to carry out the adherence of sealing tapes fitly, especially along the edges of a carton, for sealing purpose. A short brush means, moving repeatedly in a horizontal direction, which is operated by an air-actuated cylinder to reciprocate in a preset distance so that a pre-located tape, with half of it already attached to the surface along one edge of a positioned carton and the other half extending over the edge thereof, can be first treated to neatly fixed at the two corners thereof, and then an elongated brush, moving repeatedly up and down in a vertical direction, is used to complete the final adherence of the located tape along the edge thereof smoothly.

In a conventional carton-sealing machine, a carton can only be automatically sealed along the central portion of the top and bottom side thereof by elongate tapes, leaving the edges and corners sealed by manual labor, in such a manner, it results in waste of time and need of labor to carry out the sealing operation. In consideration of security against smuggling or other illegal delivery, many countries have required all the cartons in transportation must be tightly sealed, so a totally automatic carton sealing device becomes more practically useful at present than ever before.

Furthermore, a carton-sealing device of the prior art adopted a disk-shaped rotary brush means to adhere elongate tapes along the edges of a carton. However, the relatively moving carton and rotating brush means can often produce wrinkles on the sealing tapes because of relative movement therebetween.

Therefore, the primary object of the present invention is to provide an automatic tape-applying device which is particularly used to fix elongate tapes along the edges of a carton by means of a short brush, disposed at a proper position from the tape applying means and moved repeatedly in a horizontal direction, controlled by an air-actuated cylinder to smoothly and neatly fix both ends of the elongate tape at the corners thereof.

One further object of the present invention is to provide an automatic tape-applying device which is particularly used to fix elongate tapes along the edges of a carton by means of an elongate brush disposed at a proper distance beside said short brush and repeatedly moved up and down in a vertical direction when the carton to be sealed is transmitted in front thereof so that the tape can be totally and smoothly adhered along the edge of the carton The feature and operation mode of the present invention are clearly illustrated by means of the accompanying drawings which are shown and described as below:

BRIEF DESCRIPTION OF THE DRAWINGS

FIG. 5-A is an enlarged view showing the structure of the connection element;

DETAILED DESCRIPTION

Figure 1:
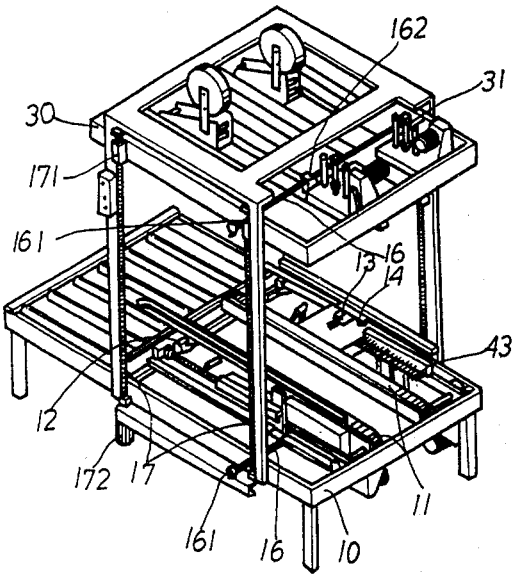
FIG. 1 is a view showing the arrangement of the present invention.

As shown in FIG. 1, the present invention is structurally in association with an upper frame 30, a lower frame 10, both equipped with conveyor belts 11 to transmit a carton to a tape applying means 12, located in symmetry at both sides of said upper and lower frame 30, 10 respectively, at where tapes are applied automatically along the symmetric edges of said carton, and the partially fixed tapes are first repeatedly brushed over by means of a pair of short brushes 13 in a horizontal direction at both corners of the edges so to adhere the tapes neatly thereat, then elongated brushes 43, operated by air actuated cylinders 31, are moved up and down repeatedly in a vertical direction to make the rest of said elongated tapes, disposed along the opposing edges, to adhere to the surface of said carton when said carton is transmitted to a selected position, so that the sealing of said carton is achieved automatically without man power.

Figure 7:
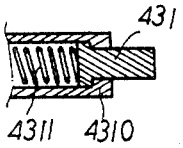
FIG. 7 is a flow chart showing a carton to be sealed being applied with an elongated tape along its edge step by step by means of the present invention.
Figure 7:
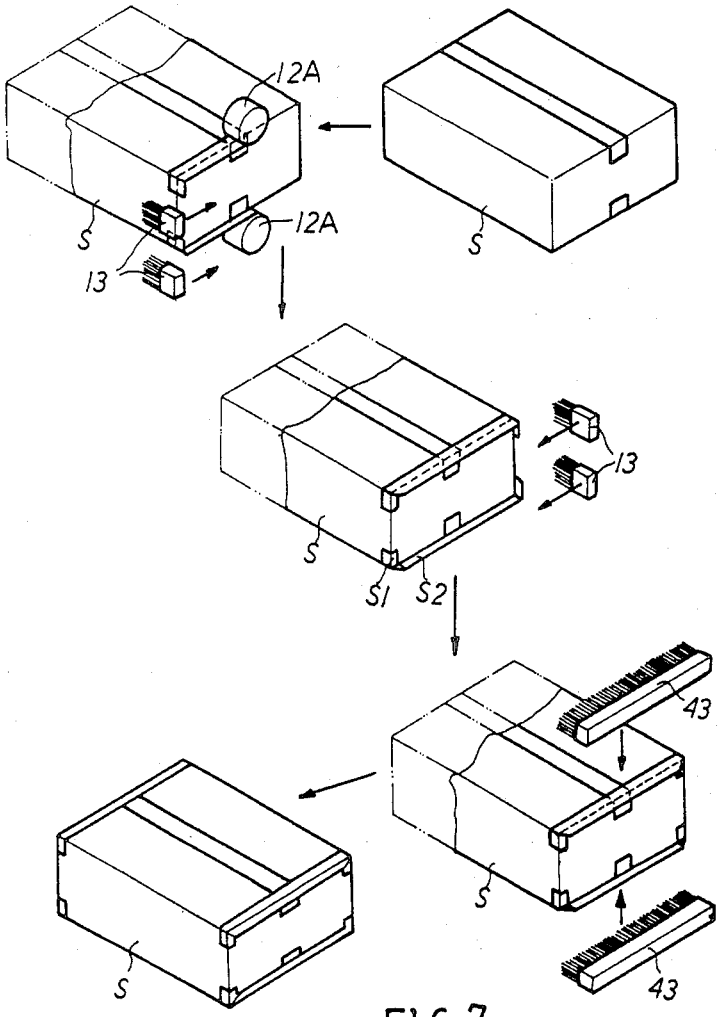

Refer to FIG. 7, the flow chart thereof shows that a carton S, transmitted by converyor belts 11 to a symmetrically-located tape applying means 12 in an up and down manner, is attached with sealing tapes along the upper and lower edges thereat, soon afterwards, short brushes 13 are actuated by cylinders 15 to brush over the fixed tapes at the corners thereof so to neatly and fitly adhere said tapes thereat, and the reversely moving brush can further flatten the tapes once again, then elongated brushes 43 are moved up and down to brush over the rest of said tapes S2 so to finally attach the same to the surface of said carton smoothly and complete the automatic sealing process.

Figure 2:
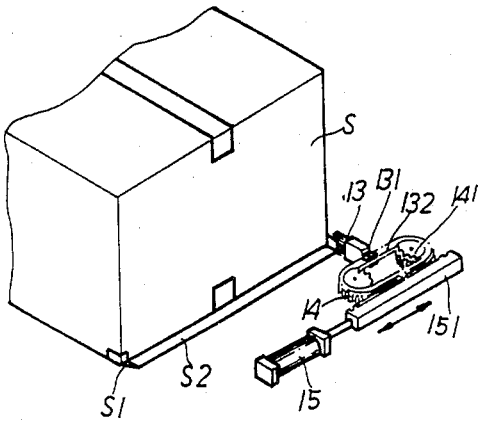
FIG. 2 is a view showing the operation of the short brush of the present invention.
Figure 3:
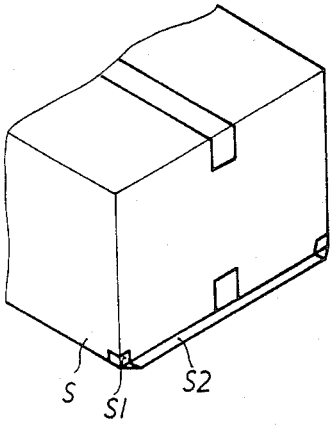
FIG. 3 is a view showing the result of the operation of said short brush on the elongate tape disposed along the edge of a carton.

Continue to refer to FIG. 1 and FIG. 2, the present invention is provided with a short brush 13 disposed at a proper position near the end of said tape applying means 12, which is able to repeatedly move in a synchronous manner within a preset range, wherein said short brush 13 has a split clamp end 131 which is used to fix said brush to a chain 132 mounted between a pair of sprockets 141 and driving gear 14 which engages with a rack 151 attached to the front of said cylinder 15 which is controlled to move in dual directions and within a selected range so that said short brush 13 can effect a repeated motion in pre-set distance to smoothly and fitly attach the tape ends S1 at the corners of said carton S to the surface thereof in a proper order, terminating the first move of the tape-fixing process, as shown in FIG. 3.

Figure 4:
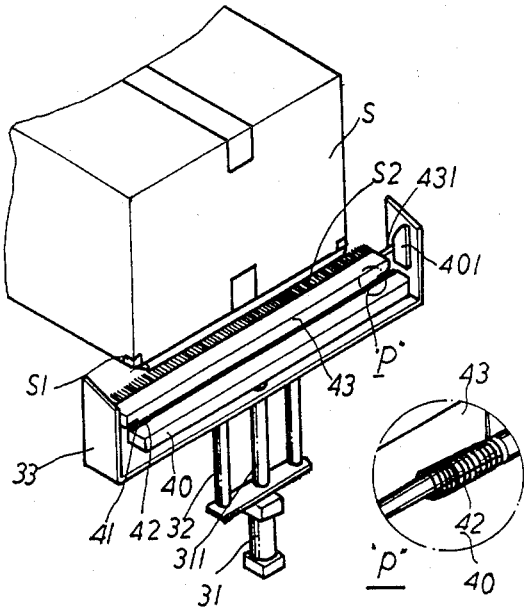
FIG. 4 is a view showing the structure of the elongated brush of the present invention.
Figure 5:
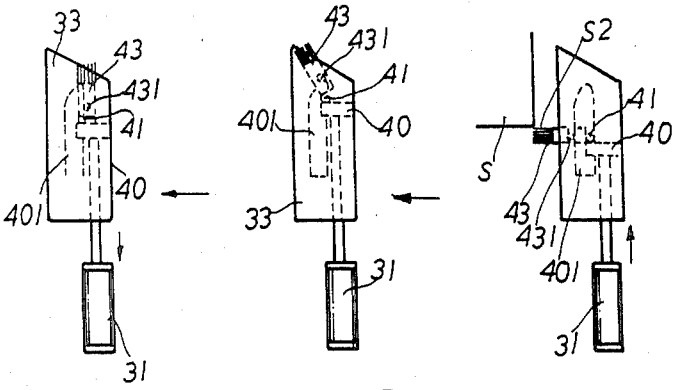
FIG. 5 is a view showing the movements of said elongated brush of the present invention.
Figure 6:
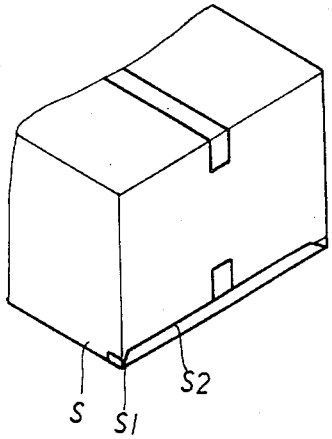
FIG. 6 is a view showing a carton being sealed along one of its edges by means of the present invention.

As further shown in FIG. 1 and 4, said carton S is continuously moved, through above-mentioned process, by means of said conveyor belt 11 to elongated brushes 43, disposed in juxtaposition to said short brushes 13 but at proper distance from each other, which is moved in vertical direction repeatedly to flatly adhere the tapes to the surface of said carton lengthwisely along the edges. At both ends of a hinge bar 41, there are attached with two twisting springs 42, and the hinge bar 41 is mounted lengthwisely along the brush actuating base 40, the bottom of which is connected to the front end of said cylinder 31 by a push bar 311 so that said elongated brush 43 can be actuated to repeatedly move up and down by said cylinder so to smoothly brush over the elongated-tape portion S2 for the completion of sealing of the carton S. There is an extended pin member 431 disposed at each end of said brush 43, which is confinedly guided in a knifeshaped protrusion 401 on a stop plate of a frame 33 respectively so that said extended pin member 431 can be slidably moved along the external contour of said protrusion 401. Said cylinder 31 and said frame 33 are joined together by means of a support structure 32 with said push bar 311 going through the bottom of said frame 33 and integrally connected to said brush actuating base 40. As shown in FIG. 5A, the extended pin member 431 disposed at each end of said elongated brush 43 is mounted on a seat 4310 in which is provided a spring 4311 in such manner that the extended pin member 431 can smoothly and resiliently move or slide along the contour of said protrusion 401; furthermore, as shown in FIG. 5, said elongated brush 43 is actuated by said cylinder 31 to brush over said tape portion S2 so to adhere the same to the surface of said carton S, and the continuously moved brush 43, resuming to its original position, is confinedly guided by said protrusion 401 and with the help of said hinge bar 41 so to be able to change the brush 43 from a horizontally-disposed position to a vertically erected position when said cylinder 31 is moving backward; by doing so, the brush 43 can leave an already sealed carton S untouched in the returning process of said brush 43 so to prevent the adhered tape S2 from being detached thereby in one respect and also prevent the brush 43 from being excessively worn out in the other.

To make the present invention flexibly suitable for cartons of different size, one of said conveyor belts 11 can be adjustably moved, and so the short and elongated brushes 13 and 43 and said tape applying means 12 be movably adjusted to the left or right on said upper and lower frame 30, 10 respectively so that the distance between said brushes can be changed according to the size of a carton. The adjustment is effected by means of an elongated worm rod 16 having a turning knob 161 disposed at one of its end, and said worm rods 16 are horizontally disposed on said upper and lower frame 30 and 10 and fixed in place by nut elements at the opposing end so that the actuation of said worm rods can effect the operation of moving one of said conveyor belts 11 to the left for right for changing the distance therebetween and so the space between said brushes.

To adjustably change the distance between the upper and lower frame 30 and 10 for receiving cartaons of different size therein, there are four vertical worm rods 17 symmetrically and vertically erected in juxtaposition to the four supporting rods of said upper frame 30, with the top ends thereof fixed to the mounting seats 171 respectively and the bottom ends provided with gear elements (not shown) which are connected to each other by a chain member so that a motor 172, located at the bottom end of a vertically-disposed worm rod 17, can actuate the upper frame 30 to move up or down for effecting the adjustment of the distance therebetween.

I claim:

1. An automatic tape-fixing device for a carton sealing machine, having means for applying tapes along the edges of a carton, and being equipped with short and elongated brushes disposed in line and at adjustable distance from each other along the upper and lower sides of upper and lower frames in a symmetric manner to apply tapes to four edges simultaneously of a forwardly moving carton, and said short and elongated brushes operated by air-actuated cylinders being disposed at a proper distance from the tape applying means, said tape-fixing device comprising:

a short brush having a split-clamp end for securing the same to a chain member driven by a pair of sprockets each having a gear located thereunder which engages with a rack disposed in front of an air-actuated cylinder so that said short brush can be actuated to repeatedly move back and forth;

an elongated brush being disposed in line and at proper distance, next to said short brush, and provided with an extended pin at each end thereof which is in contact association with a knife-shaped cam protrusion for confinedly guiding the movement of said elongated brush by means of the contour of said cam protrusion, and said elongated brush being connected to a brush actuating base by an elongate hinge bar having a pair of twisting springs located at each end thereof to change the operating position of said brush actuating base. and an air-actuated cylinder being secured to the bottom of the base;

the above-mentioned components being structured so that the components are disposed in pairs on an upper and lower frame, four worm rods being disposed between the frames and secured to said upper frame with their top ends by four mounting seats, and at the bottom ends thereof being provided with sprockets, connected to each other by a chain member so that said four worm rods can be simultaneously actuated to rotate by a motor located at the bottom end of one worm rod to effect adjustment of the distance between said upper and lower frames, the distance between conveyor belts disposed on said upper and lower frames being changed by moving one of said conveyor belts to the left or right by means of a worm rod horizontally disposed with one end thereof secured to a mounting seat and the other end attached to a turning knob so that the conveyor belts can be adjusted for cartons of different size.

* * * * *